US006722968B2

(12) United States Patent
Rizzo et al.

(10) Patent No.: US 6,722,968 B2
(45) Date of Patent: Apr. 20, 2004

(54) CONVERSION ATTACHMENT FOR BENCH GRINDER TOOL REST

(75) Inventors: Nanette Rizzo, Allison Park, PA (US); David Hollinger, Glenshaw, PA (US); Charles Baird, Pittsburgh, PA (US)

(73) Assignee: Orion International, Pittsburgh, PA (US)

( * ) Notice: Subject to any disclaimer, the term of this patent is extended or adjusted under 35 U.S.C. 154(b) by 0 days.

(21) Appl. No.: 09/750,808

(22) Filed: Dec. 28, 2000

(65) Prior Publication Data

US 2002/0086629 A1 Jul. 4, 2002

(51) Int. Cl.[7] ..... B24B 3/00
(52) U.S. Cl. ..... 451/406; 451/65; 451/293
(58) Field of Search ..... 451/65, 282, 293, 451/340, 364, 377, 380, 387, 406

(56) References Cited

U.S. PATENT DOCUMENTS 979,880 A * 12/1910 Olds ..... 451/258
1,875,486 A * 9/1932 Peaslee ..... 285/920
2,922,263 A * 1/1960 Bogert, Sr. ..... 451/365
3,373,530 A * 3/1968 Cooprider ..... 451/406
4,216,560 A * 8/1980 Schmidt ..... 15/268
4,347,639 A * 9/1982 Le Tarte ..... 451/406
5,172,484 A 12/1992 Triola
5,505,655 A 4/1996 Haffely et al.
5,527,210 A * 6/1996 Sharer ..... 451/246

* cited by examiner

*Primary Examiner*—Joseph J. Hail, III
*Assistant Examiner*—Anthony Ojini
(74) *Attorney, Agent, or Firm*—Greer, Burns & Crain, Ltd.

(57) ABSTRACT

An attachment for a bench grinder having at least one grinding surface, a tool rest fastener and a tool rest is described. The attachment includes a tool-receiving plate having a bottom surface and a top surface. The bottom surface is configured to matingly engage the tool rest surface. The top surface includes one of a flat surface and a surface having an angled V-shaped groove that is shaped and configured to receive a drill bit or and hold it at a fixed elevation and angle relative to the grinding surface. A slotted flange is normally attached to the tool-receiving plate, is configured to engage the slot with the tool rest fastener while the tool-receiving plate rests on the tool rest surface, and to abut the flange against the attachment surface to hold the attachment immobile during use.

17 Claims, 5 Drawing Sheets

CONVERSION ATTACHMENT FOR BENCH GRINDER TOOL REST

BACKGROUND OF THE INVENTION

This invention is directed to an improved attachment for a bench grinder to hold drill bits or other tools in preparation for sharpening. More specifically, it relates to attachments to temporarily convert a flat tool support into a tool support for sharpening drill bits, or for converting a tool rest for drill bits into a flat tool support.

Tools commonly used for cutting, such as chisels, gouges, planes, knives and lawn mower blades, have cutting surfaces that do not function properly if not kept sharp and free of surface imperfections. Dull blades require application of more force to the tool in order to cut a workpiece, potentially cutting too deeply or posing a safety hazard. Surface imperfections in such tools can impart defects in the cut surface of the workpiece, particularly during woodworking. A chisel or planer with a gouge in the cutting surface will leave an imperfection on a workpiece that requires additional sanding or finishing to obtain an acceptable surface appearance.

Drill bits also become dull with use, and it is advantageous to be able to use a grinder to restore the cutting edge to its original quality. For optimum sharpness, the tip of a drill bit cannot simply be held flat against a grinding surface. The tip of the drill bit forms a cone whose sides slope at an angle of 118° from the sides of the drill bit. Maintenance of the optimum cutting surface requires that the conical shape be retained as much as possible. It is therefore necessary that the bit be held to the grinding surface at a 62° angle as precisely as possible. In addition, the bit should be continuously rotated to minimize formation of flat areas on the cone.

Bench grinders are commonly used in the home to sharpen tools with cutting edges that have become nicked, dull or worn. The grinder sharpens or repairs the cutting edge of such tools by wearing away a small portion of the metal until a sharp, flawless edge is achieved. An accessory commonly used with bench grinders is a tool rest or tool support that supports the tool at an appropriate height so that it can more easily be sharpened. A commonly used tool rest consists of a flat surface that is either permanently or removeably attached to the grinder. Without any tool rest, it is extremely difficult, even for an experienced workman, to hold a drill bit at precisely 62° while rotating it for the length of time needed to sharpen the bit.

Even where the tool support surface can be tilted to various angles, in most cases, adjustment of the surface angle must be accomplished entirely by hand, setting up to four elements to lock the tool rest at a selected angle and elevation. Setting the proper elements and holding the round bit in the same position for consistent results is very difficult under these conditions.

More recently, grinders have become available with a permanently attached tool rest specifically designed with a V-shaped channel to hold drill bits in an appropriate position for sharpening. The groove is generally oriented to hold the drill bit at an angle of approximately 62°, characteristic of the shape of the cutting tip of the bit. However, use of this type of tool rest is not advantageous for use when sharpening many other types of cutting surfaces. For example, a chisel may be placed on the tool rest with a portion of the blade on the flat area of the tool rest and a portion of the blade over the V-shaped channel. A downward force on the blade during sharpening could cause the blade to shift into the V-shaped channel changing its angular orientation, wearing away the edge at an inappropriate angle and causing damage to a portion of the blade.

Further, the groove that holds drill bits at a characteristic angle of 62° is not useful for other small items that may require sharpening. Removal of a nick or gouge in the blade of a flat head screwdriver, for example, would not benefit from this type of tool support, since the angle does not hold the screwdriver in a position appropriate for grinding.

Since no single tool rest optimally sharpens all types of tools, there exists a need for attachments for permanently mounted tool rests to convert easily and inexpensively from one type to another.

It is, therefore, an object of this invention to provide an improved attachment that adapts a tool rest to hold either flat tools or drill bits in an optimum position for sharpening.

It is another object of this invention to provide an improved drill bit sharpening attachment that mounts on a bench grinder without removal of an existing flat tool rest.

It is still another object of this invention to provide an improved adapter for converting a tool rest to a flat surface, without removal of a grooved tool rest for sharpening drill bits.

It is yet another object of this invention to provide an improved drill bit sharpening attachment that is easily removed, providing convenient access to a permanently installed flat tool rest.

SUMMARY OF THE INVENTION

The above-listed objects are met or exceeded by the present tool rest attachment, which features a removable platform for converting a flat tool rest to one specially designed to sharpen drill bits, or vice versa.

More specifically, the present invention provides an attachment for sharpening of either a tool or a drill bit with a bench grinder. The attachment is designed to be used on a grinder having at least one grinding surface and a tool rest that is attached with a tool rest fastener. The tool rest has a tool rest surface and attachment surface at right angles to each other.

The attachment has a tool-receiving plate with a bottom surface and a top surface. The bottom surface is shaped and configured to matingly engage the tool rest surface. The top surface comprises one of a flat surface and a surface having an angled V-shaped groove that is shaped and configured to receive a drill bit and hold it at a fixed elevation and angle relative to the grinding surface. If the top surface is flat, it is designed to support a tool at a fixed height relative to the grinding surface.

A slotted flange is normally attached to the tool-receiving plate. It is sized and configured to engage the slot with the tool rest fastener. While the tool-receiving plate rests on the tool rest surface, it abuts the flange against the attachment surface when the tool rest fastener is tightened, to hold the attachment immobile during use.

During use, the attachment acts as an adapter to convert a flat tool rest to one useful for sharpening drill bits or adapts a grooved tool rest to one with a flat support surface. Single tool rests that attempt to provide the versatility to accomplish both of these tasks, generally require many manual settings to change the height and angle of the tool rest. The attachment of the present invention permits conversion from one type of tool rest to another, without removal of the permanently mounted tool rest.

This attachment is very simple to use. When the different surface is required, the user need only loosen the fastener, drop the attachment into place and tighten the fastener again. In seconds, a sturdy, secure surface is available for grinding of either drill bits or other tools.

Removal of the attachment, and return to the original tool rest surface is equally simple. The user need only loosen the fastener, remove the attachment, and retighten the fastener in its original position. There is no need to replace the permanently mounted tool rest. Further, this attachment is easy and inexpensive to manufacture.

This attachment provides an additional advantage when sharpening drill bits. The groove in the attachment is designed to hold the bit in the exact optimum position of 62°. Compared to manually setting angles and positions on the tool rest, this method is more accurate and consistent, leading to sharper bits. Less grinding, and therefore less metal removal, is required to obtain a good edge, resulting in longer lasting tools.

DETAILED DESCRIPTION OF THE DRAWINGS

DETAILED DESCRIPTION OF THE INVENTION

Figure 1:
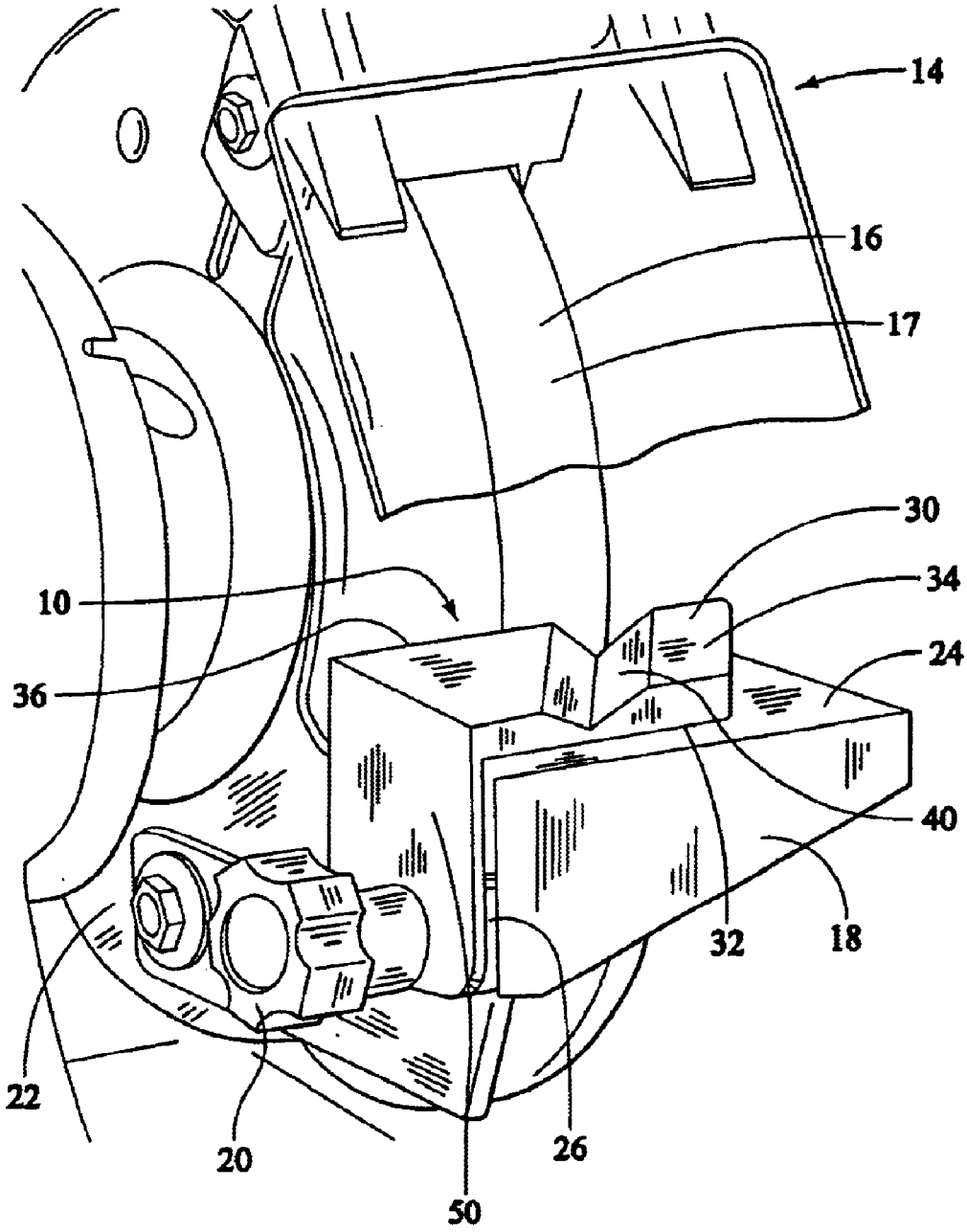
FIG. 1 is a perspective view of a bench grinder with the conversion attachment installed thereon.

Referring to FIG. 1, an attachment, generally designated 10, is shown that is used for sharpening a tool or drill bit (not shown), with a bench grinder, generally designated 14. The grinder 14 with which the attachment 10 is intended to be used must have at least one wheel surface 16, a tool rest 18, and a tool rest fastener 20 that secures the tool rest to a base 22 of the grinder. Generally, the tool rest 18 has a tool rest surface 24 and an attachment surface 26. Most often these surfaces 24, 26 will be oriented at right angles to each other, however, other angles may be used.

Although a grinding surface 17 is the most commonly used as the wheel surface 16, and is referenced here, it is to be understood that this invention is applicable to any type of wheel that is available for use with a bench grinder 14. In addition to grinders 17, other wheels that are offered include those with wire bristles or polishing surfaces. After sharpening a tool, a wire brush is preferably used to remove metal filings, or a polishing wheel used to put a finer edge on the tool. These steps are particularly convenient when they can all be done right at the bench grinder 14 simply by changing the wheel or moving to an additional wheel surface 16.

The tool rest surface 24 is most often flat. Alternately, an attachment 10' could be made to convert a tool rest 18 with a grooved surface to a flat-surface tool rest. If there were sufficient demand for such an item, a similar attachment could be made to matingly engage with and rest upon a tool rest surface 24 of any shape. Two embodiments are described. In the first embodiment, best shown in FIG. 2, the tool rest surface 24 is flat, and is being converted to a grooved surface for use in sharpening drill bits. The attachment 10' is used to convert a grooved tool rest surface 24 to a flat surface in a second embodiment, shown in FIG. 3.

Figure 2:
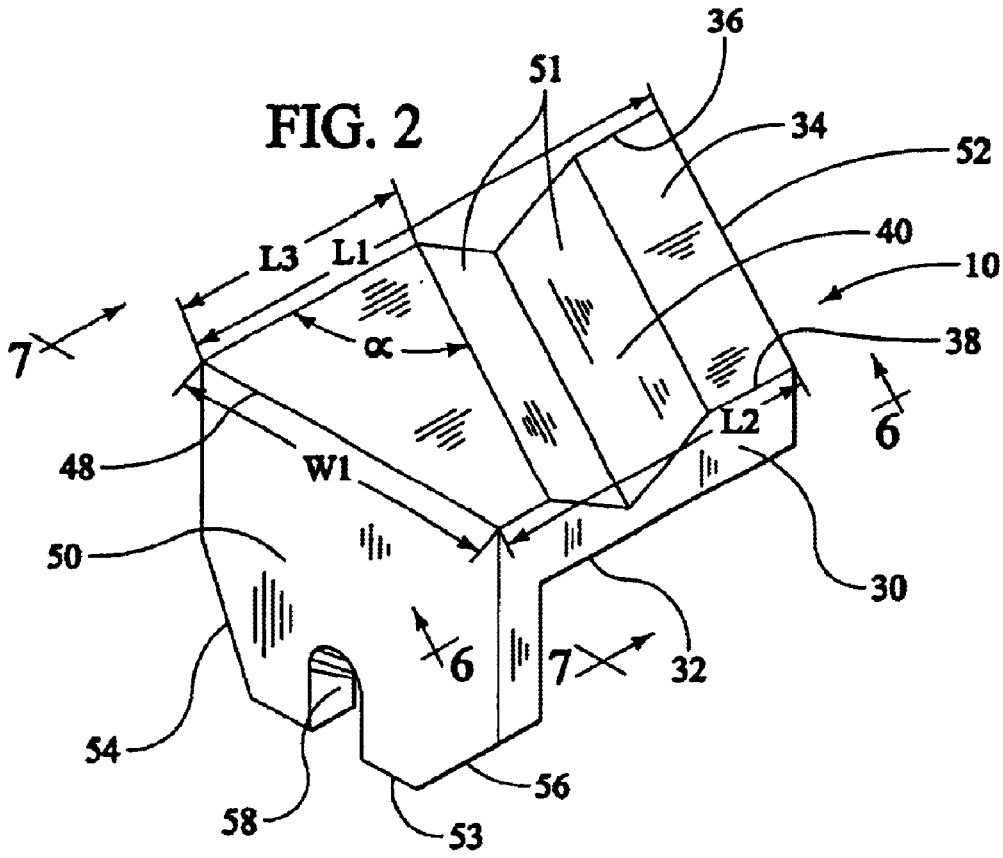
FIG. 2 is a perspective view of the first embodiment of the present attachment.

Referring now to FIG. 2, a tool-receiving plate 30 is the working surface of the attachment 10. The tool-receiving plate 30 has a bottom surface 32 and a top surface 34. A forward edge 36 closest to the wheel surface 16 has a length, L1, and a rear edge 38 opposite the forward edge 36 has a length L2. The top surface 34 is where, during use, drill bits or other tools are placed for support during grinding. The overall length, L1, and width, W1, of the tool-receiving plate must be sufficient to provide a work surface that is large enough to be useful, but small enough that access to the grinding surface by larger items is not impaired. Most preferably, the length, L1, is from about 1.0 to about 2.5 times the width, W1.

The width, W1, of the tool-receiving plate 30 is particularly important in the first embodiment. When sharpening drill bits, it is most advantageous to continuously rotate the bit. Placement of the bit during sharpening in one position too long causes flat spots on the tip of the bit. It is therefore important that the user be able to grasp the bit in order to turn it. Thus, it is preferable that the width, W1, of the tool-receiving plate 30, not exceed the length of the smallest drill bit that the user intends to sharpen. It is therefore preferred that W1 not exceed 50 mm, and even more preferred that W1 be less than 45 mm.

Figure 3:
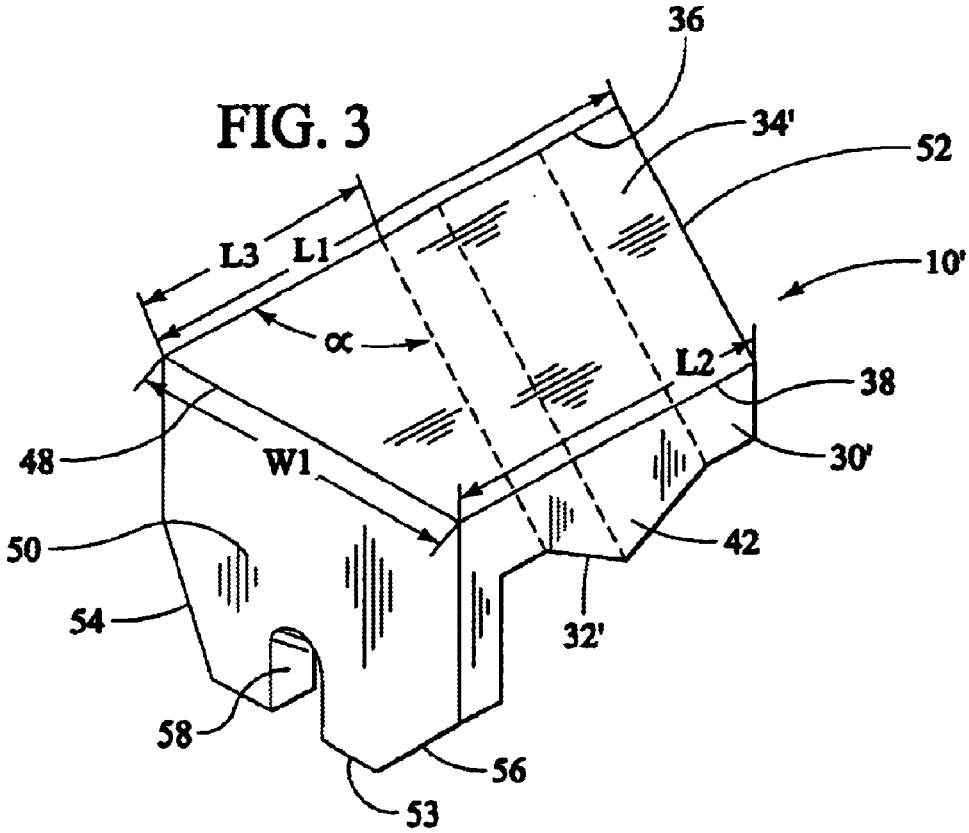
FIG. 3 is a perspective view of the second embodiment of the present attachment.
Figure 4:
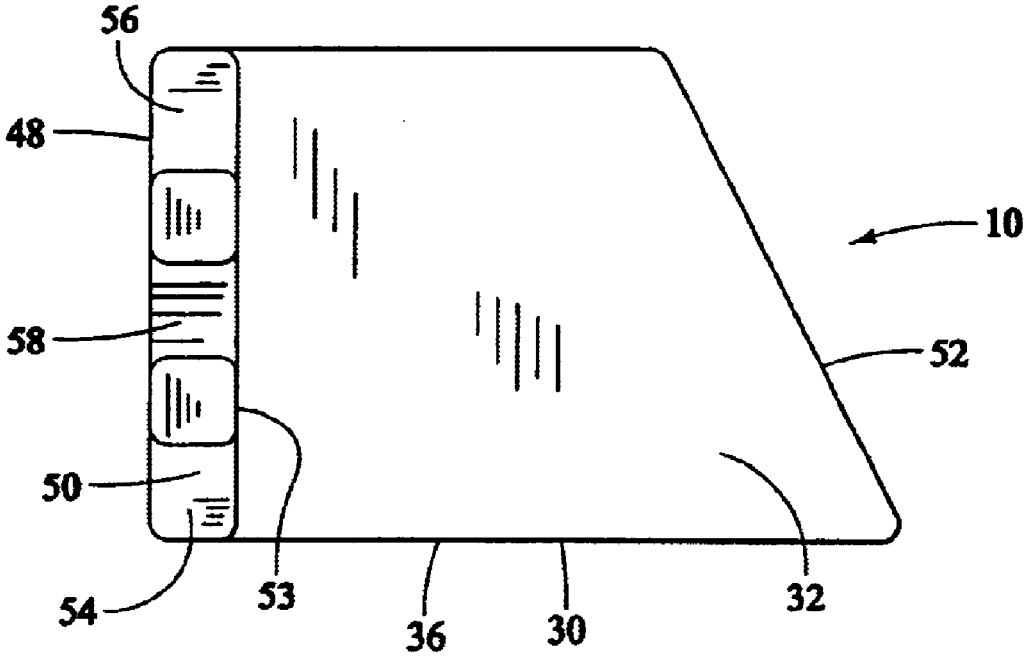
FIG. 4 is a bottom plan view of the attachment shown in FIG. 2.
Figure 7:
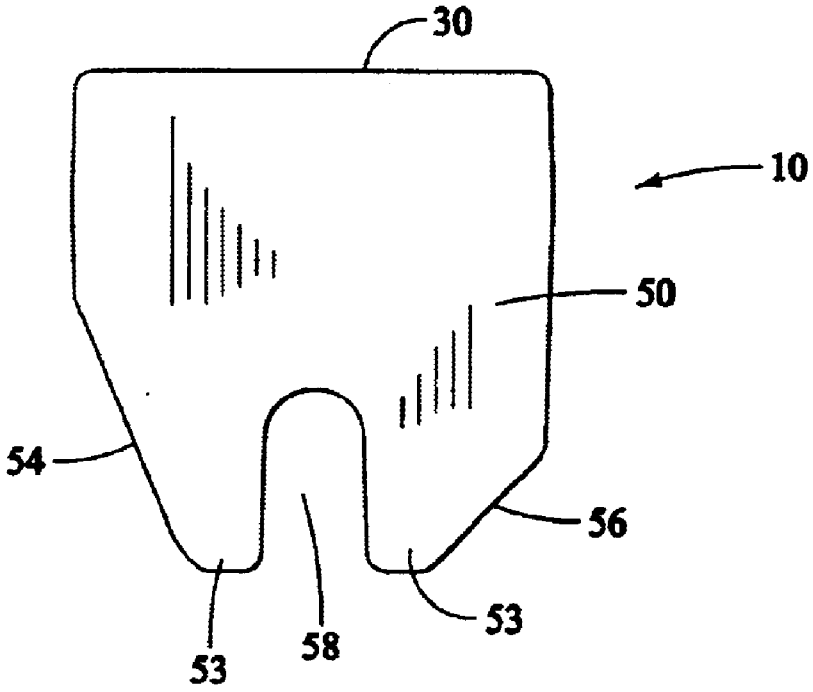
FIG. 7 is a side elevational view of the attachment shown in FIG. 2 as viewed along line 7—7 and in the direction indicated.

The bottom surface 32, as shown on FIGS. 2, 3 and 4 of the tool-receiving plate 30 is shaped and configured to matingly engage the tool rest surface 24 of the tool rest 18. For the purposes of this invention, the bottom surface 32 and the tool rest surface 24 are considered to be matingly engaged if the surfaces are planar as well as non-planar. Referring first to FIGS. 2 and 4, in the embodiment 10, when the tool rest surface 24 is substantially flat, the bottom surface 32 will be correspondingly flat. However, referring now to FIG. 3, in an alternate embodiment, generally designated 10', if the tool rest surface 24 has any other shape, the bottom surface 32 must be configured with an inverse shape so that, when placed together, the bottom surface 32 of the attachment 10' conforms to the shape of the tool rest surface 24 to provide a stable platform for the tool-receiving plate 30. Aside from the construction of the bottom surface 32', the embodiment 10' is virtually identical to the attachment 10, and has been designated with like reference numbers. For ease of discussion, while the main focus will be on the attachment 10, it will be understood that the description also applies to the attachment 10'.

In the second embodiment 10', the tool rest surface 24 has a shaped or non-planar surface, and the bottom surface 32' is preferably shaped to matingly engage with the tool rest surface. As shown in FIG. 3, the bottom surface of this embodiment includes a depending, V-shaped projection 42 that preferably has generally the same angle and dimension, similar in configuration and orientation to a V-shaped groove 40, as discussed further below. Thus, when the attachment 10' is placed on top of the tool rest 18, the projection 42 fits within the groove 40. Further, such mating engagement of the tool rest 18 with the attachment 10' acts as a locking mechanism against lateral movement of the attachment during use. Thus, it is contemplated that the attachment 10, 10' will either have a grooved top surface 34 and a flat bottom surface 32, or a flat top surface 34' and a bottom surface 32' with the projection 42.

The top surface 34, 34' is the surface that is configured to support drill bits, or other tools of interest, during sharpening or grinding. Usually, the overall shape and dimensions of the top surface 34, 34' will be the same as that of the bottom surface 32', although shapes with sloped sides or changing dimensions are contemplated for use with this invention. In the second embodiment, the top surface 34' of the attachment 10' is substantially flat.

Referring back to FIG. 2, in the first embodiment, to provide convenient support for drill bits, the angled V-shaped groove 40 in the tool-receiving plate 30 is oriented and configured to receive the drill bit and hold it at a fixed elevation and angle relative to the grinding surface 17. To hold the tip of the drill bit at the optimum angle, the groove 40 is placed at an angle, $\alpha$, of from about 59° to about 65°. Optimally, $\alpha$ is 62°, the supplemental angle to the shape of the drill bit tip, 118°. Preferably, $\alpha$, is from about 60° to about 64°, and most preferably from 61° to 63°. The groove 40 preferably runs the entire width of the attachment 10, from the forward edge 36 to the rear edge 38, so that the user can grasp the bit to rotate it while sharpening. As discussed here, the angles are measured from the forward edge 36, based on an assumption that the forward edge 36 is parallel to the grinding surface 17. Where the forward edge 36 is at any other orientation, $\alpha$ should be measured with respect to the grinding surface 17.

Figure 5:
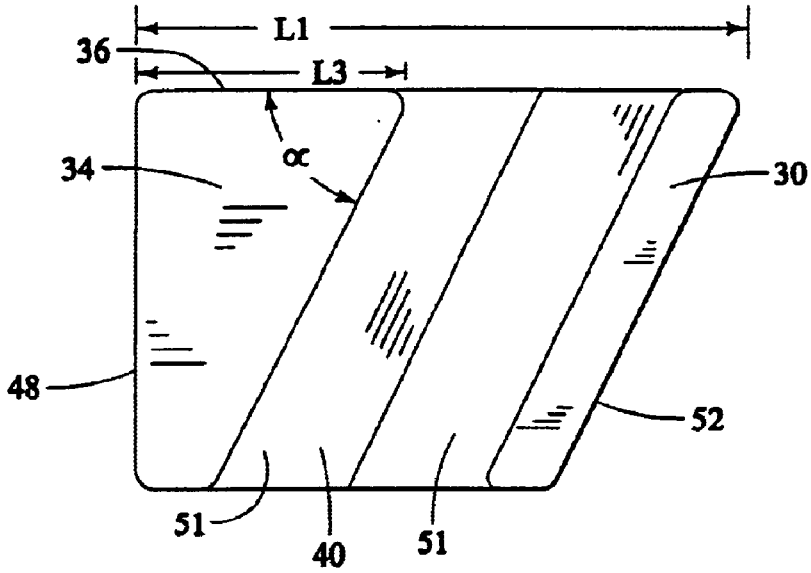
FIG. 5 is a top plan view of the attachment shown in FIG. 2.

As shown in FIG. 5, the position of the groove along the length L1, of the top surface 34 preferably changes to fit the specific bench grinder 14 with which the attachment 10 is intended to be used. L3 defines the distance along the forward edge 36 between the center of the V-shaped groove 40 and a common edge 48 between the tool-receiving plate 30 and a slotted flange 50. Preferably this forward edge 36 is parallel to the grinding surface 17 of the wheel 16. L3 should be chosen to place the tip of the drill bit near the right side of the grinding wheel 16.

Figure 6:
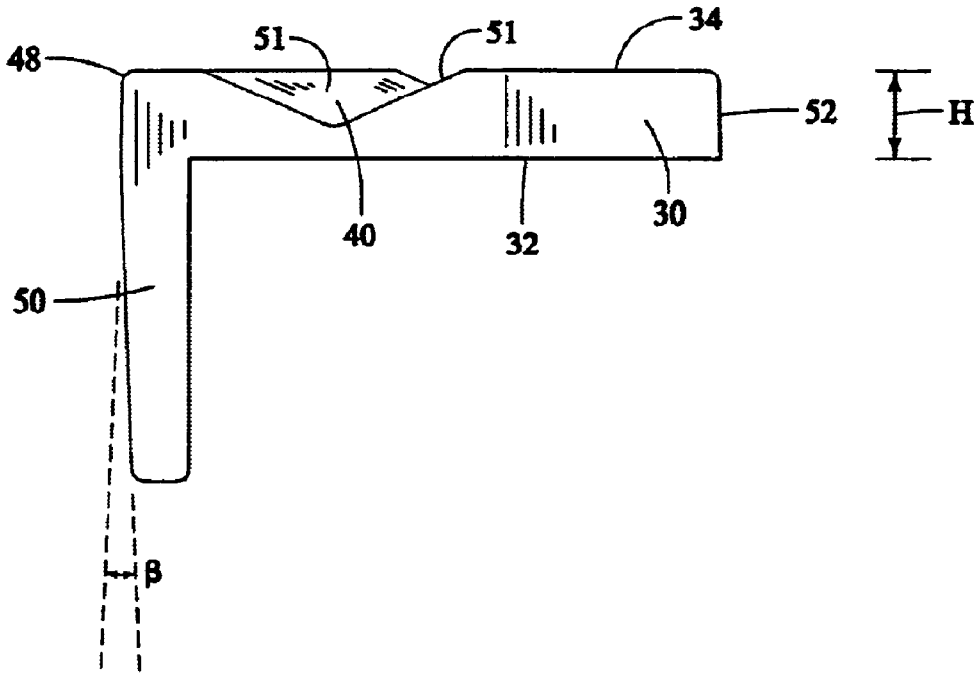
FIG. 6 is a side elevational view of the attachment shown in FIG. 2 as viewed along line 6—6 and in the direction indicated.

Size and thickness of the V-shaped groove 40 may vary as long as the drill bits are held securely within it, as shown in FIGS. 5 and 6. The groove 40 must be wide enough that large drill bits do not slip out of the groove. In the preferred embodiment, the V-shaped groove 40 is symmetrical, having equal slope on both sides 51 of the "V". However, it is contemplated that either side 51 may be at a steeper angle than the other.

Preferably, the thickness or height 'H' (FIG. 6) is such that the attachment 10 does not bend easily and provides a sturdy working surface, particularly in the center of the V-shaped groove 40. If the groove 40 has insufficient depth, the bits will move on the tool-receiving plate 30 as if it were flat. Preferably, the depth of the V-shaped groove 40 is from about ½ to ¾ of the overall thickness H of the tool-receiving plate 30. The overall thickness H of the tool-receiving plate 30 depends on the material from which it is made. However, excessive thickness requires additional raw materials that are not utilized, increasing the cost of the product unnecessarily. While the attachment is made of die cast aluminum, the overall thickness is preferably from about 5 mm to about 15 mm.

A trapezoid is the preferred shape of the surfaces 32, 34, on the tool-receiving plate 30 although any shape may be used that provides sufficient surface to grind or sharpen the desired tools. A free edge 52 is on the opposite side of the tool-receiving plate 30 from the common edge 48. As shown, L2 is preferably less than L1, such as the case where the free edge 52 of the tool-receiving plate 30 is formed to be parallel to the V-shaped groove 40. This provides a sufficient surface area for the intended use, but minimizes cost by eliminating raw materials for excess surface that is unlikely to be used.

Except as noted above, other overall dimensions of the tool-receiving plate 30 are variable. Size and placement of the tool rest 18 varies depending on the manufacturer or model of the bench grinder 14. Changes in dimensions of the attachment 10 to fit specific models of the tool-receiving plate of bench grinder 14 are intended to be within the scope of this invention.

Size and shape of the slotted flange 50 is variable as discussed above so long as it engages the tool rest fastener 20 and the attachment 10, 10' matingly engages the tool rest surface 24. As few as two tines 53 extend from the tool-receiving plate 30 to the tool rest fastener 20, or as many as desired for a specific grinder configuration. The preferred shape includes a substantially flat plate, most preferably having a length, from the common edge 28 to the end of the tines 53, which is approximately equal to the width W1. When there is a large contact surface between the slotted flange 50 and the attachment surface 26 of the tool rest 18, increased friction reduces movement between the surfaces, making the contact between the two apparatuses more stable. Preferably, angled edges 54, 56 on the slotted flange 50 minimize use of the raw material used to manufacture the attachment 10, thus minimizing the cost without impairing the usefulness of the device.

The slotted flange 50 normally attaches to the tool-receiving plate 30 at the common edge 48, and is preferably integrally joined thereto. It is important that the plate 30 remain stationary while in use. Movement of the plate 30 during a polishing or grinding action may lead to an uneven edge being formed, or inadvertent nicking or chipping of the cutting surface. The slotted flange 50 and tool-receiving plate 30 may be joined by any means, but preferably form an L-shaped device of unitary construction.

Figure 8:
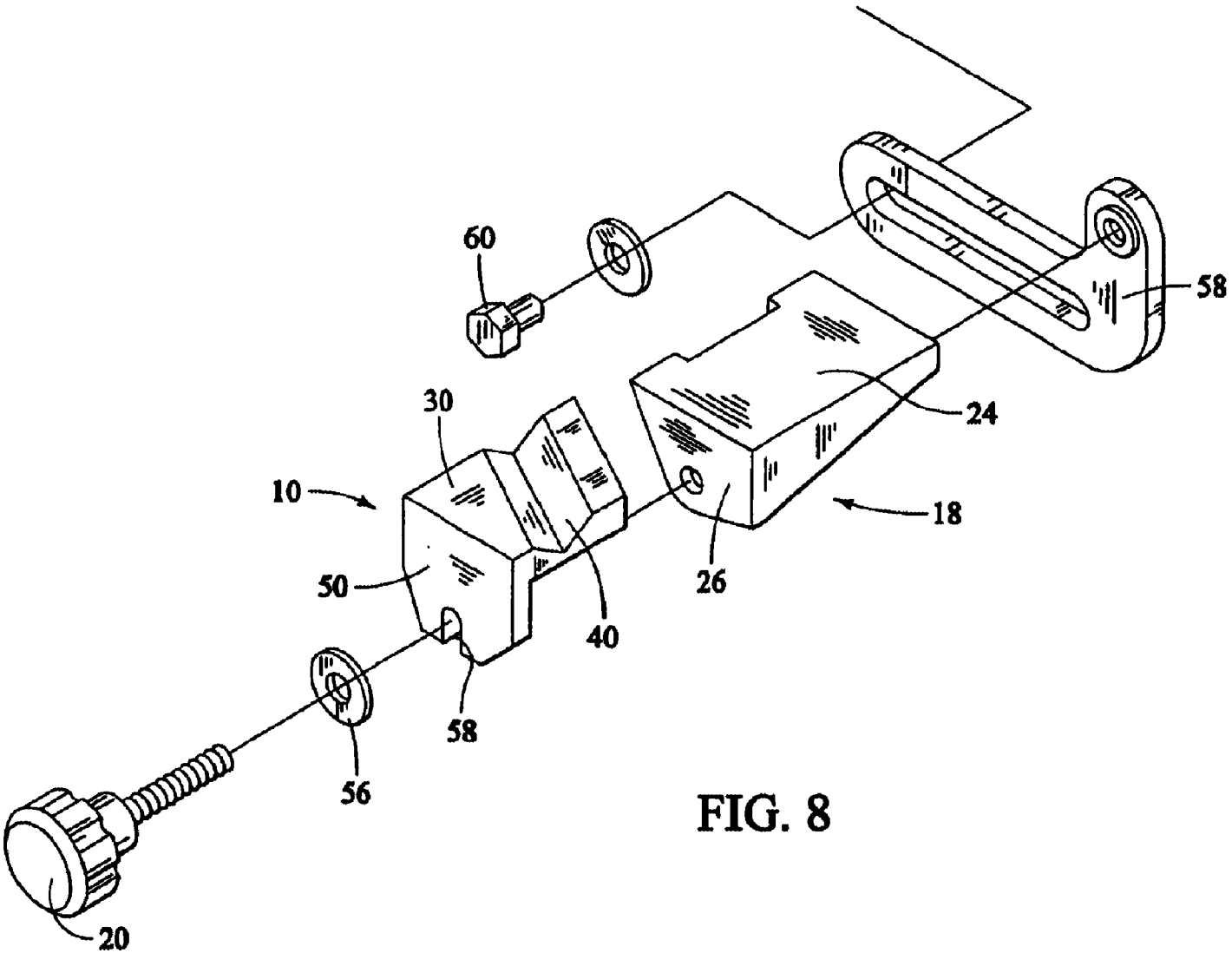
FIG. 8 is an exploded, perspective view of the present attachment and a preferred mounting assembly.

A preferred mounting assembly is shown in FIG. 8. Attachment of the tool rest 18 to the bench grinder 14 is usually accomplished by means of a removable tool rest fastener 20, which also engages a slot 58 on the slotted flange 50. The flange 50 is generally sized and configured to engage a slot 58 with the tool rest fastener 20 while the tool-receiving plate 30 is matingly engaged with the tool rest surface 24. When placed in this position, the flange 50 should abut the attachment surface 26 of the tool rest 18 to hold the attachment 10 immobile during use when the tool rest fastener 20 is tightened.

Optionally, a washer 56 is used when fastening the attachment 10 to the tool rest 18. When suitable, the tool rest fastener 20 is fastened directly to the base 22 of the bench grinder 14, or it optionally attaches to a bracket 58. A supplemental fastener 60 is then used to mount the bracket 58 to the bench grinder base 22.

Referring now to FIG. 6, thickness of the slotted flange 50 preferably diminishes at an angle $\beta$, from the common edge 48 to the slot 58. Less than 5% change in thickness is sufficient to aid in manufacture by aiding release of the attachment 10 when made in a mold. More preferably, $\beta$ is such that there is less than 3% change in thickness. Overall, the slotted flange 50 should be thick enough that it has the strength to hold the tool-receiving plate 30 in a secure position. Making the slotted flange 50 thicker than necessary adds to the cost of the raw materials, and merely increases the cost of the attachment 10.

The attachment 10 is suitably manufactured from one of a variety of materials. Rigidity is the most important quality of the material from which the unit is made, to minimize movement during use. The material preferably has sufficient compression strength that it does not crack, break or deform when the user bears down on the drill bit or tool 14 to hold it in place. Since the tool rest 18 supports the tool-receiving plate 30, tensile strength is less important. Preferred materials include wood, metal, and rigid plastics. Rust-free metals, such as aluminum are most preferred. Die casting is the preferred method of manufacture.

While a particular embodiment of the conversion attachment for a bench grinder tool rest feature of the invention has been shown and described, it will be appreciated by those skilled in the art that changes and modifications may be made thereto without departing from the invention in its broader aspects and as set forth in the following claims.

What is claimed is:

1. An attachment for sharpening one of a tool and a drill bit with a bench grinder having at least one grinding surface, a tool rest fastener and a tool rest, the tool rest having at least a tool rest surface and an attachment surface oriented at generally right angles to each other, comprising:

a tool-receiving plate having a bottom surface and a top surface, said bottom surface is configured to have one of a flat and a depending projection dimensioned to engage the corresponding tool rest surface, said top surface comprising one of a substantially flat surface and a surface having an angled V-shaped groove that is configured to receive the drill bit and hold it at a fixed elevation and angle relative to the grinding surface; and a slotted flange normally attached to said tool-receiving plate, configured to engage said slot with the tool rest fastener while said tool-receiving plate rests on the tool rest surface, and to abut said flange against the attachment surface when the tool rest fastener is tightened, to hold said attachment immobile during use.

2. The attachment of claim 1 wherein said flange comprises a flange plate.

3. The attachment of claim 2 wherein said flange plate diminishes in thickness toward said slot.

4. The attachment of claim 2 wherein at least two edges of said flange plate angle toward said slot.

5. The attachment of claim 1 wherein said slotted flange and said tool-receiving plate are of unitary construction.

6. The attachment of claim 1 wherein said attachment is made up of at least one of wood, plastic and metal.

7. The attachment of claim 6 wherein said attachment is made of aluminum.

8. The attachment of claim 1 wherein the length of said slotted flange is approximately equal to the width of said tool-receiving plate.

9. The attachment of claim 2 wherein said flange plate diminishes in thickness toward said slot.

10. The attachment of claim 9 wherein said diminution in flange plate thickness is less than 5°.

11. An attachment for sharpening a drill bit with a bench grinder having at least one grinding surface, a tool rest fastener and a substantially flat tool rest, the tool rest having at least a flat tool rest surface and an attachment surface disposed at generally right angles to each other, comprising:

an L-shaped attachment of unitary construction comprising;

a bit-receiving plate including a bottom surface, having a flat surface; and dimensioned to engage the corresponding tool rest surface, and a top surface, said bottom surface resting on and supported by the tool rest surface, said top surface having an angled V-shaped groove that is configured to receive the drill bit and hold it at a fixed elevation and angle relative to the grinding surface; and a slotted flange plate normally attached to said bit-receiving plate, configured to engage said slot wit the tool rest fastener while said tool-receiving plate rests on the tool rest surface, and to abut said flange against the attachment surface to hold said attachment immobile during use.

12. The attachment of claim 11 wherein said V-shaped groove is configured so that the angle at which the drill bit is held ranges from about 59° to about 65°.

13. The attachment of claim 11 wherein at least a forward edge of said tool-receiving surface is parallel to the grinding surface.

14. The attachment of claim 13 wherein said V-shaped groove is at an angle from about 59° to about 65° relative to said forward edge.

15. The attachment of claim 14 wherein said V-shaped groove has a depth between 50% and 75% of the depth of said tool-receiving plate.

16. The attachment of claim 11 wherein at least a free edge of said tool-receiving surface is parallel to said V-shaped groove.

17. The attachment of claim 11 wherein the depth of said V-shaped groove is less than half of its width.

* * * * *